United States Patent [19]

Hodge

[11] 4,393,608

[45] Jul. 19, 1983

[54] LAND FORMING AND EARTH MOVING EQUIPMENT

[76] Inventor: John R. Hodge, Nathalia-Katamatite Rd., Numurkah, Victoria, Australia, 3636

[21] Appl. No.: 299,170

[22] Filed: Sep. 3, 1981

[30] Foreign Application Priority Data

Sep. 2, 1980 [AU] Australia ..... PE5364/80

[51] Int. Cl.[3] ..... E02F 5/00

[52] U.S. Cl. ..... 37/124; 37/126 AA; 37/126 AD; 37/DIG. 4; 37/117.5

[58] Field of Search ..... 37/8, 124, 126 R, 126 A, 37/126 AA, 126 AB, 126 AC, 126 AD, 126 AE, 129, DIG. 3, DIG. 4, DIG. 9, DIG. 13, 117.5; 172/687, 701, 454, 462, 468–470, 472

[56] References Cited

U.S. PATENT DOCUMENTS

| | | | |
|---|---|---|---|
| 2,103,588 | 12/1937 | LeBleu | 37/124 |
| 2,136,203 | 11/1938 | Adams | 37/126 AA |
| 2,216,235 | 10/1940 | French | 37/DIG. 4 |
| 2,227,450 | 1/1941 | Gurries | 37/126 R |
| 2,380,021 | 7/1945 | Brown et al. | 37/129 |
| 2,414,933 | 1/1947 | Daniels | 37/126 AA |
| 2,528,741 | 11/1950 | Clark | 37/129 |
| 2,984,026 | 5/1961 | Thompson et al. | 37/126 AB |
| 3,962,804 | 6/1976 | Hyler | 37/126 AA |
| 4,015,348 | 4/1977 | Gee et al. | 37/129 |
| 4,023,285 | 5/1977 | Hancock et al. | 37/126 R X |

*Primary Examiner*—E. H. Eickholt

*Attorney, Agent, or Firm*—Holman & Stern

[57] ABSTRACT

Earth moving and land forming equipment and specifically that which can be used as a scraper and transporter or as a grader, the equipment having an open rectangular frame having a forward and rearward section pivotally connected together with a scraper blade at the forward end of the rearward section adjacent the pivot. The equipment has at its forward end means for connection to the draw bar of a tractor or the like and at its rearward end road wheels. The height of the scraper blade can be adjusted by relative rotation of the frame sections about the pivot and the equipment is also provided with an apron which can be moved from a position away from the scraper blade to a position where it is adjacent the blade and thus restricts movement of earth from a container behind the blade; ripper tynes which can be moved from an operative to an in-operative position and means associated with the land wheels whereby the transverse angle of the frame can be varied.

17 Claims, 11 Drawing Figures

23
22
20
21
21
70
70
15
11
14a
75
77
58
4
53
50
75
71
58
10
14
13a
13
16a
16
40
42
101
8
12
25
25
30
43
41
48
43
30
34
34
32
10
10
47
60
4
61
90
30
31a
30
31
33
33
8

LAND FORMING AND EARTH MOVING EQUIPMENT

BACKGROUND OF THE INVENTION

This invention relates to improvements in land forming and earth moving equipment having a load carrying container supported by land wheels and adapted to be hitched to a tractor or other prime mover.

1. Field of the Invention

In order to make more efficient use of irrigation water there has, over the last few years developed a practice which entails land forming extensive land areas which are to be irrigated. This involves levelling of the land to permit irrigation water to be evenly received thereon. The levelling of large areas of land is effected by the use of tractor drawn scrapers or planers and graders which normally use laser beam techniques to control the scraping and/or grading operations. The scraping operation requires the use of one type of equipment to remove earth and dump it in low areas, a grader being then used to finally level off the area. It has been proposed to provide earth moving equipment capable of operating both as a scraper or as a grader.

Whatever equipment is used in these land forming operations, relatively heavy, powerful and costly equipment is required in view of the large quantities of earth to be moved and, consequently, efficient operation of such equipment is necessary to economically achieve the aims of the land former operations.

The principal object of the present invention is to provide an improved construction of land forming and earth moving equipment which will operate more efficiently and effectively as a scraper or as a grader.

2. Description of the Prior Art

According to the invention, earth moving and land forming equipment includes an open frame formed as a forward section and a rearward section pivoted together on a transverse axis, the forward section adapted to be connected at its forward end to a tractor draw bar and the rear of the rearward section being supported at each side by land wheels, the wheels on each side being carried on an arm pivotally on said rearward section, a fixed scraper blade at the pivoted end of said rearward section, a load carrying container behind the scraper blade, hydraulic rams connected between the said forward and rearward sections, on each side of the frame pivot to effect raising and lowering movements to said pivot and thus to the scraper blade.

Preferably there are two pairs of land wheels on each side.

The equipment of the invention above described may operate as a scraper and as a grader, however, in order to increase its effectiveness as a scraper there may be included between the wings in the forward frame section an apron in the form of an open sided container arranged to increase the load carrying capacity of the equipment, the upper end of which is pivotally supported at each side by connected cranks, control pins at the sides of the apron extend through guide tracks, formed in the wings, to engage the ends of hydraulic rams arranged to move the control pins along the guide tracks thereby to move the apron from a lower operative position to an inverted inoperative position where the apron is clear of the load carrying container as it assumes its load dumping position.

One or more transverse members of the forward frame section may have pivotally mounted thereon a plurality of ripper tynes, preferably arranged in staggered formation, said tynes are held in a raised inoperative position by an hydraulically controlled pivoted bar or plate, which upon release, allows the tynes to assume an upright position for ripping the soil in advance of the scraper blade and thereby assisting the operation of said blade, the ripper tynes may be arranged to be individually or connectively retracted from the operative position.

The land wheels supporting the rearward frame section are preferably carried on arms pivotally mounted within the said frame section, the load carrying container being recessed on each side to accommodate the forward pairs of wheels on each arm. Preferably each wheel of each pair is mounted on opposite sides of the arm and with the axes of each wheel pair offset with respect to the other. The pivot mounting of one of the wheel carrying arms may be cranked and under the control of an hydraulic ram so that the transverse angle of the container may be varied as required.

In order that the invention may be more readily understood I shall describe one form of the equipment in relation to the accompanying drawings, in which:

DESCRIPTION OF THE PREFERRED EMBODIMENTS

Figure 1:
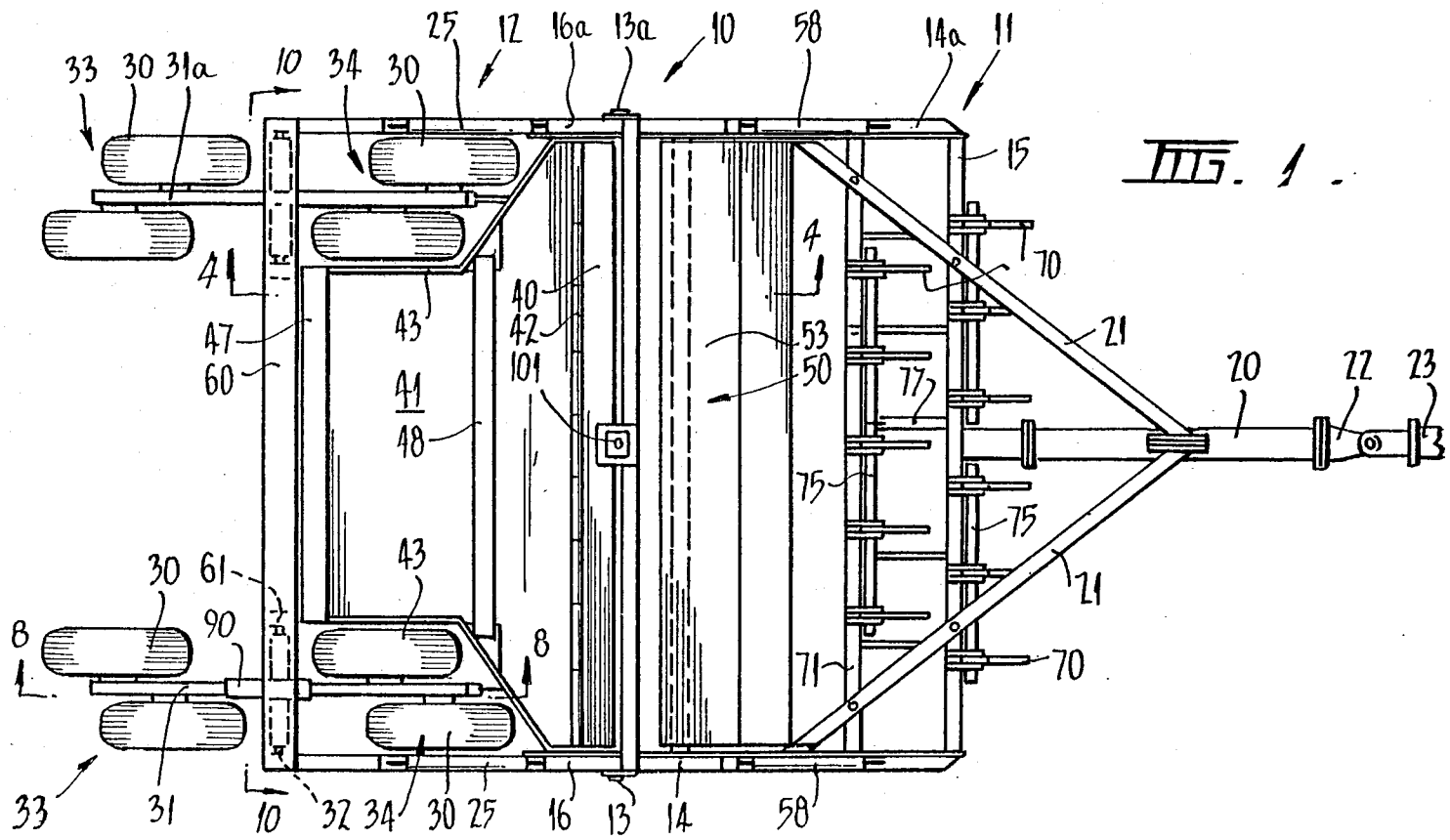
FIG. 1 is a plan view of the equipment made in accordance with the invention.

In considering this description it is to be kept in mind that the particular configuration of the components and their manner of construction may vary depending on the size of the equipment. The drawings show a piece of equipment which has an overall length of 4600 mm (15 feet) and a length of 9000 mm (30 feet) and is adapted to carry up to 14 cubic meters (17 cubic years) of soil. Substantial variations can be made in these dimensions whilst providing equipment which embodies the invention.

Referring to the illustrated embodiment of the invention the earth moving equipment comprises an open rectangular frame 10 formed from a forward section 11 and a rearward section 12 pivoted together by pivots 13, 13*a* which lie on a transverse axis, i.e. the sides are pivoted together on a common axis.

The forward section includes a front member 15 and two side members 14, 14*a*, the pivots 13, 13*a* being at the free ends of the side members 14, 14*a*. Fitted to the front member 15 there is a main central tractor hitch member 20 and angular stay members 21 connect the hitch member 20 to the front member 15 and the sides 14, 14*a* of the forward section 11. The free end 22 of the hitch member may be connected to a tractor draw bar 23 in known manner.

The rearward section 12 has two side members 16, 16*a* and a rear member 17, the pivots 13, 13*a* being at the free ends of the side members.

The rear of the rearward section 12 is supported at each side by two pairs 33, 34 of land wheels 30. The wheels on each side, which are preferably pneumatic tyred wheels, are carried on an arm 31, 31*a* mounted on a pivot 32, 32*a* on the rearward frame section 12. The rearward end 18 of each side 16 of the rearward section 12 has an upwardly directed member 19 which can comprise a support for one side of one of the pivots 32, 32*a*. A transverse member 60 is connected between the upper end of members 19 and vertical members 61 connected between the members 17 and the members 60 support the other side of the pivots 32, 32*a*.

Each wheel 30 of each pair is supported on opposite sides of the pivoted arms 31, 31*a* with the axes of each wheel pair offset to each other.

We have found that this offsetting and pivotal mounting of the wheel pairs enables the equipment, whether used as a scraper or grader, to be operated at much faster rates than has heretofore been possible and that grader bounce or oscillation may be eliminated or minimised. The pivot mounting 32 of one of the wheel carrying arms 31 is carried in an eccentric mounting, which will be described more fully in relation to FIGS. 8–11, so that the transverse angle of the frame 10 may be varied under the control of an hydraulic ram.

A fixed scraper blade 40 mounted on a sub-frame 45 is arranged between the sides 16, 16*a* across the forward end of the rearward frame section just rearwardly of the frame pivots 13, 13*a* and the lower forward edge of a load carrying container 41 is pivoted by a piano type hinge 42 to the subframe 45 behind the rear edge of the scraper blade 40.

The load carrying container 41 has a floor 46, the forward end of which is connected to the hinge 42, two sides 43 which, as can be seen from FIG. 1 are shaped to receive the forward pair 34 of land wheels and a closed rear wall 47.

Figure 4:
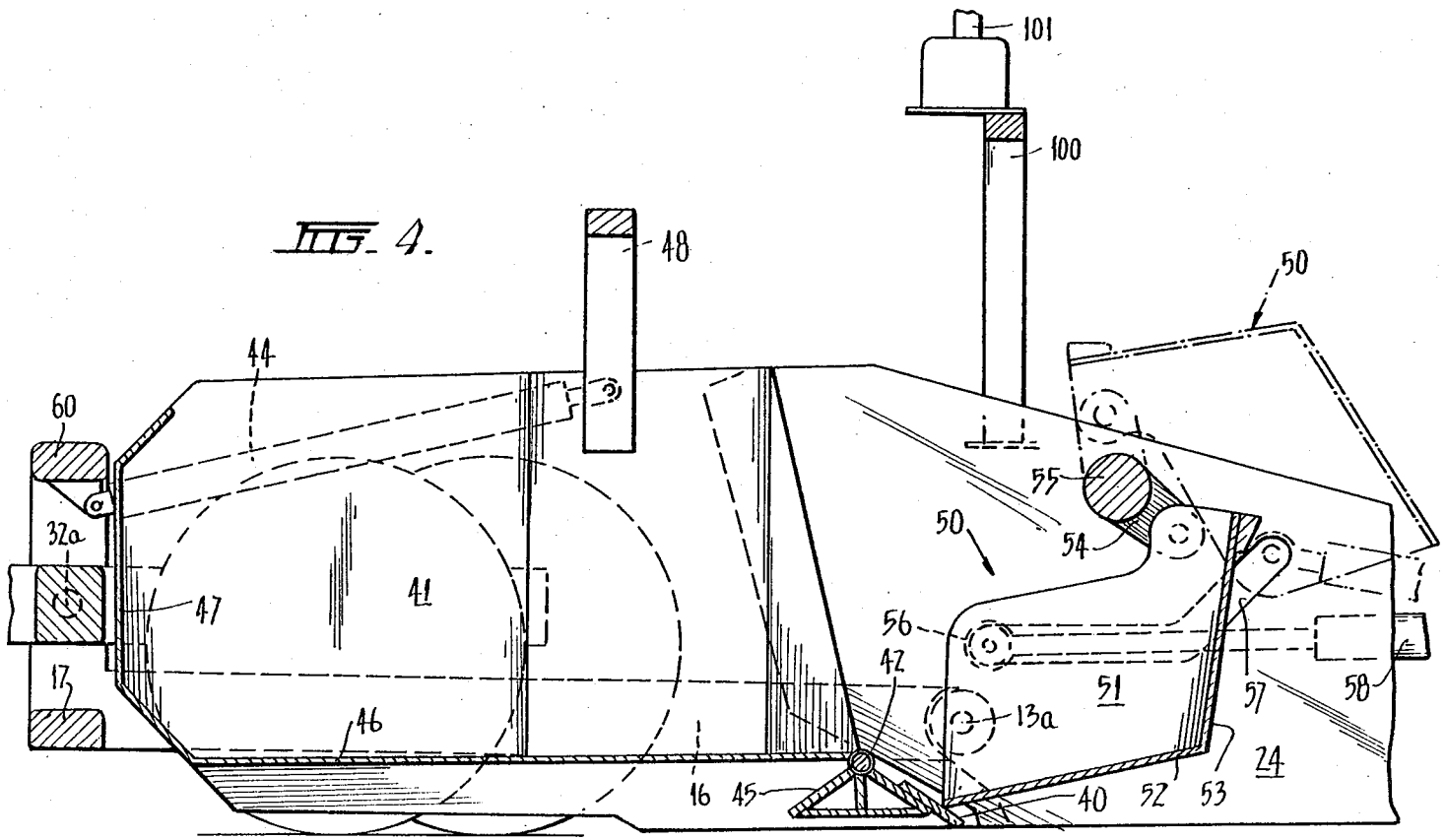
FIG. 4 is an enlarged section along line 4—4 of FIG. 1 showing, in full line the position of the apron and the container in the transport condition and in chain dash the apron in its raised position.

The rearward section 12 of the frame of the equipment is so formed that the container 41 can rest in the location shown in FIG. 4.

Figure 5:
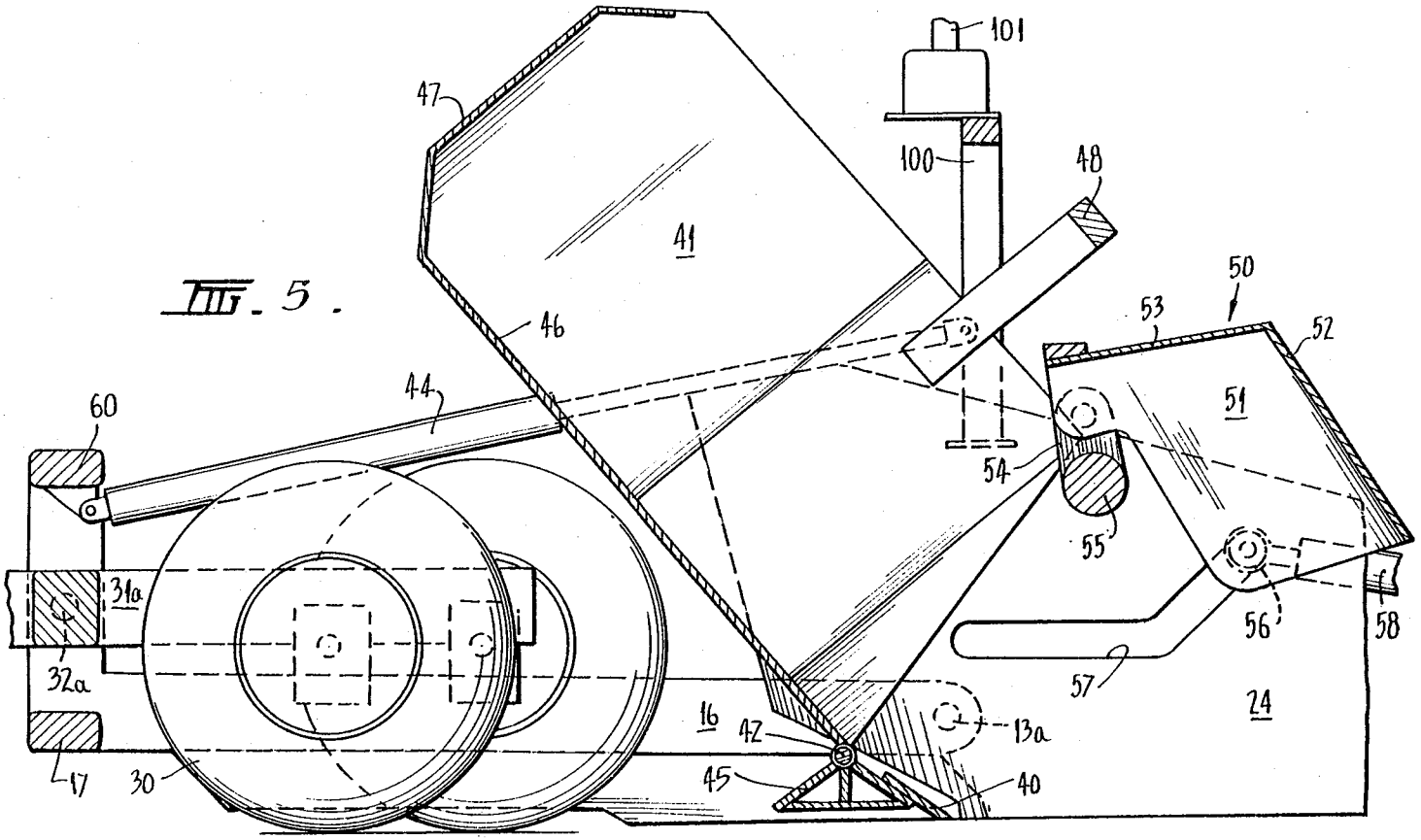
FIG. 5 is a view similar to that of FIG. 4 showing the container in the condition where its contents can be distributed, being also the condition in which the equipment can be used as a grader.
Figure 6:
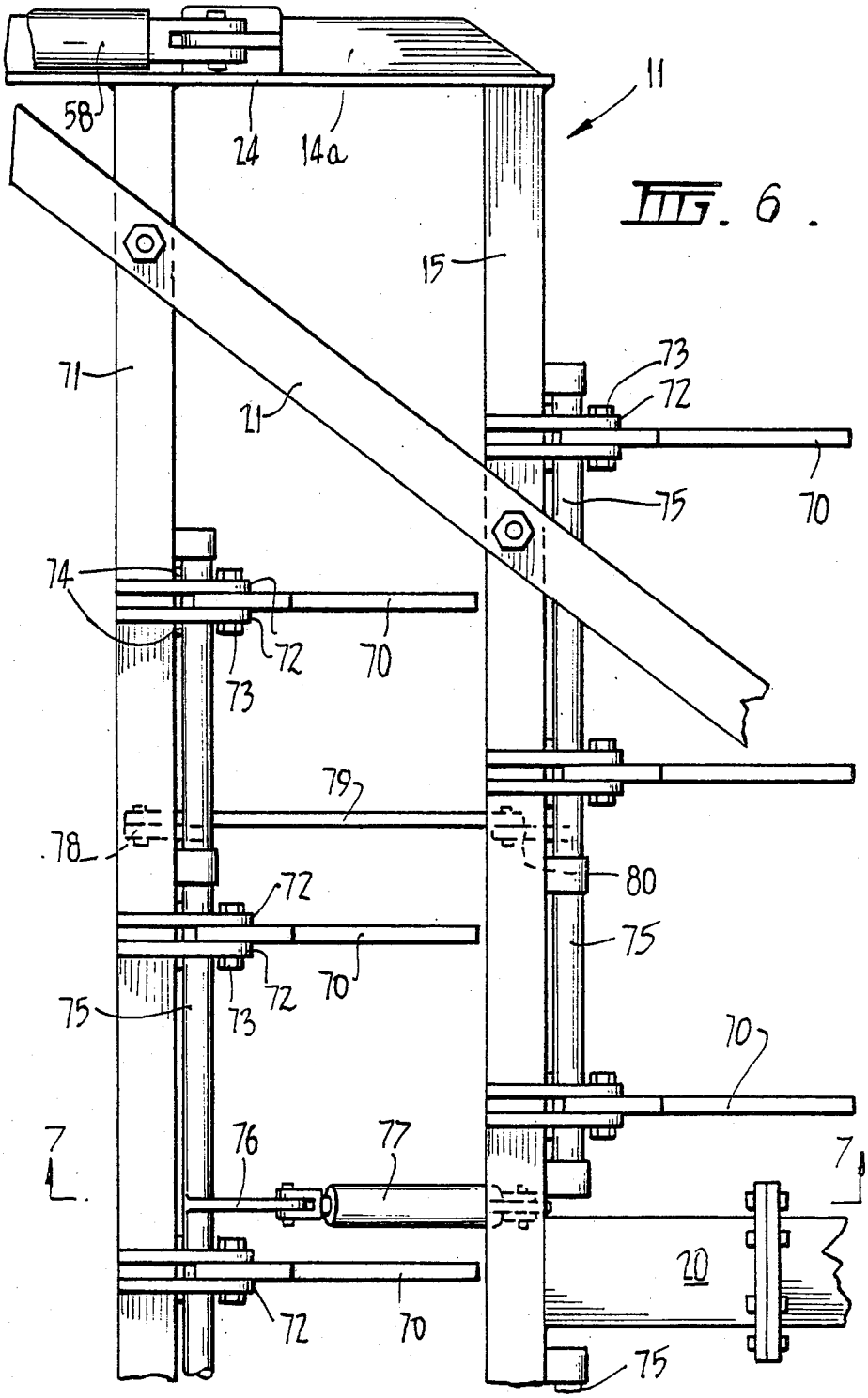
FIG. 6 is an enlarged plan view of the upper portion of the frame and tyne assembly similar to that of portion of FIG. 1 but showing in more detail the arrangement of mounting of the tynes.

The sides 43 of the load carrying container, adjacent their upper forward portions may be interconnected by a U-shaped assembly 48 to which is pivotally connected hydraulic rams 44, the other ends of which are attached to the underside of the transverse member 60 of the rear frame so that upon extension of the rams 44, as shown in FIG. 5, the container 41 is raised about its hinge mounting 42 to the scraper blade sub-frame 45. The raising of the container is to either effect dumping of its load or to enable the bottom of the container to act in conjunction with the scraper blade 40, as a grader.

Wings 24 are provided at each side 14, 14*a* of the forward frame section 11 to control soil spillage when the equipment is being operated as a scraper.

Hydraulic rams 25 are connected between the upper rear edge 26 of the wings and the sides 16, 16*a* of the rearward frame section 12 the arrangement being such that, upon extension or contraction of the rams 25, the frame sections pivots 13, 13*a* are raised or lowered causing the raising or lowering of the scraper blade 40 to thereby control the operation thereof.

Figure 2:
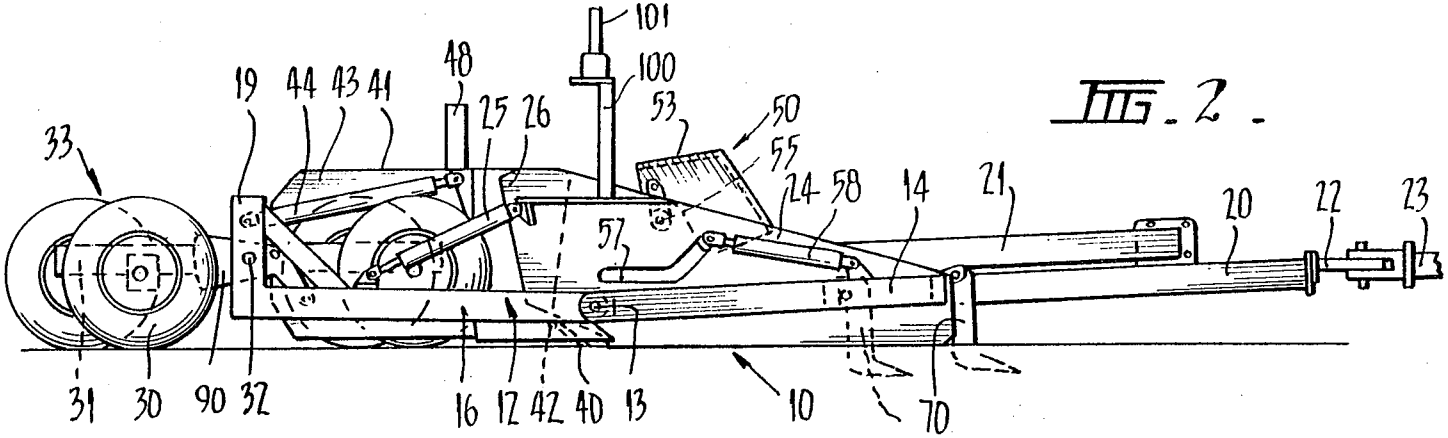
FIG. 2 is a side elevational view of the equipment showing the tynes in their operative position loosening the surface of the ground and the leading edge of the load carrying container acting as a scraper to feed material loosened by the tynes into the container.
Figure 3:
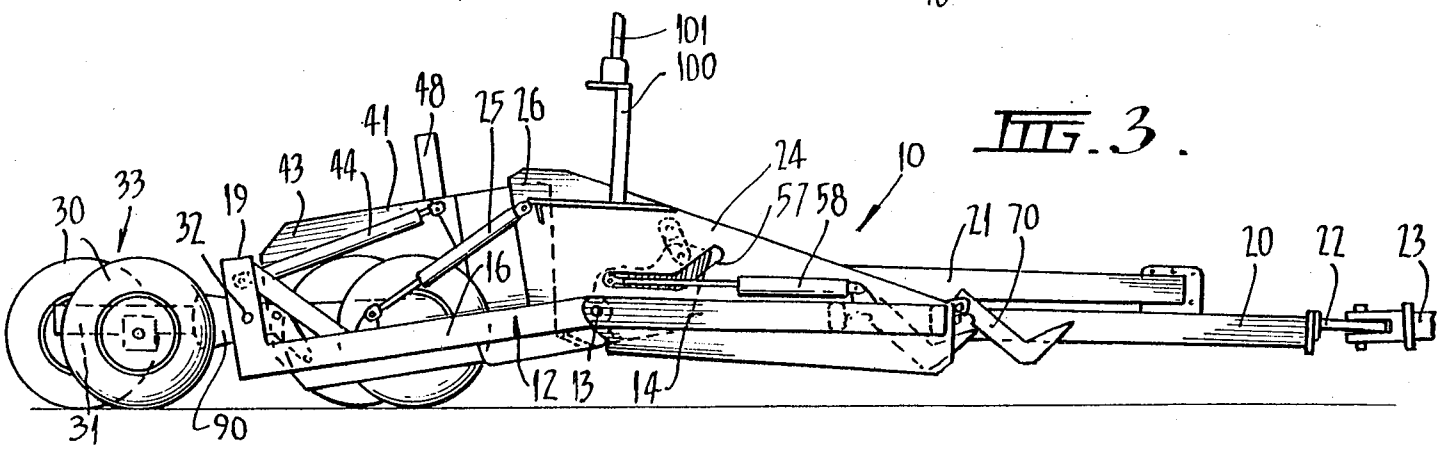
FIG. 3 is an elevation similar to that of FIG. 2 showing the tynes in their retracted, non-working position and with the apron closing the forward end of the load carrying container so that the equipment can be transported being the condition in which it is used when carrying soil.

This is best shown in FIGS. 2 and 3. In FIG. 2 the equipment is in its working condition with the scraper blade 40 being in contact with the ground. By controlled movements of the rams 25 the depth of cut of the scraper blade can be adjusted. FIG. 3 shows the equipment in its transport condition in which the rams 25 are fully extended and the equipment can be towed without any ground contact.

To increase the effectiveness of the equipment as a scraper in carrying soil, the forward frame section 11 is provided with an apron 50 in the form of a container which, as illustrated in the orientation shown in FIG. 2, has two side walls 51, a closed front face 52 and a closed top 53. In this condition the apron 50 does not obstruct the entrance of soil into the container 41. It will be appreciated that as the container fills there is a build up of soil at the entrance thereof and if the equipment was simply moved to the configuration of FIG. 3 portion, at least, of this would be left. Previously attempts have been made to provide aprons to prevent this loss but it has been found that the density of the soil has impeded the movement of the apron.

The apron of the present invention is designed, as will be described hereafter, to move in an arcuate manner in which the resistance is minimized and the effective capacity of the load carrying container can be maximized. The final position of the apron is shown in FIGS. 3 and 4.

The apron 50 is located between the wings 24 and, in its upper position, as best illustrated in FIGS. 2 and 5, is pivotally attached to a crank 54 adjacent the rear of the top 53. The pivot 55 of the crank may be a bar which extends across the width of the equipment between the wings 24. In the side walls 51 of the apron there are control pins having rollers 56 thereon which extend through formed guide slots 57 in the wings.

It is the combination of the movement of the crank 54 about its pivots and the rollers 56 in the slots 57 which permit the required arcuate movement of the apron between its extreme positions.

The outer ends of the pins engage hydraulic rams 58, the other ends of which are connected to the side members 14, 14*a* which rams are adapted to move the control pins and thus their rollers along the guide slots 57.

In order to break the soil for receipt by the scraper blade 40 I provide a plurality of tynes 70 on the front of the forward frame member 11.

The tynes 70 are mounted on the front member 15 and a member 71 parallel thereto and spaced rearwardly therefrom. The tynes on the two members are laterally spaced.

Each tyne is mounted between a pair of plates 72 by a pivot 73. The rear edges of the tynes, when in their working position, illustrated in solid line in FIG. 7, abut a plate 74 which is pivotally mounted on a rotatable bar 75 journalled to the transverse member.

The plates 74 can abut the adjacent transverse members and thus, whilst the tynes are free to rotate, they are restrained to maintain their working position when pressure is applied to their cutting point.

Figure 7:
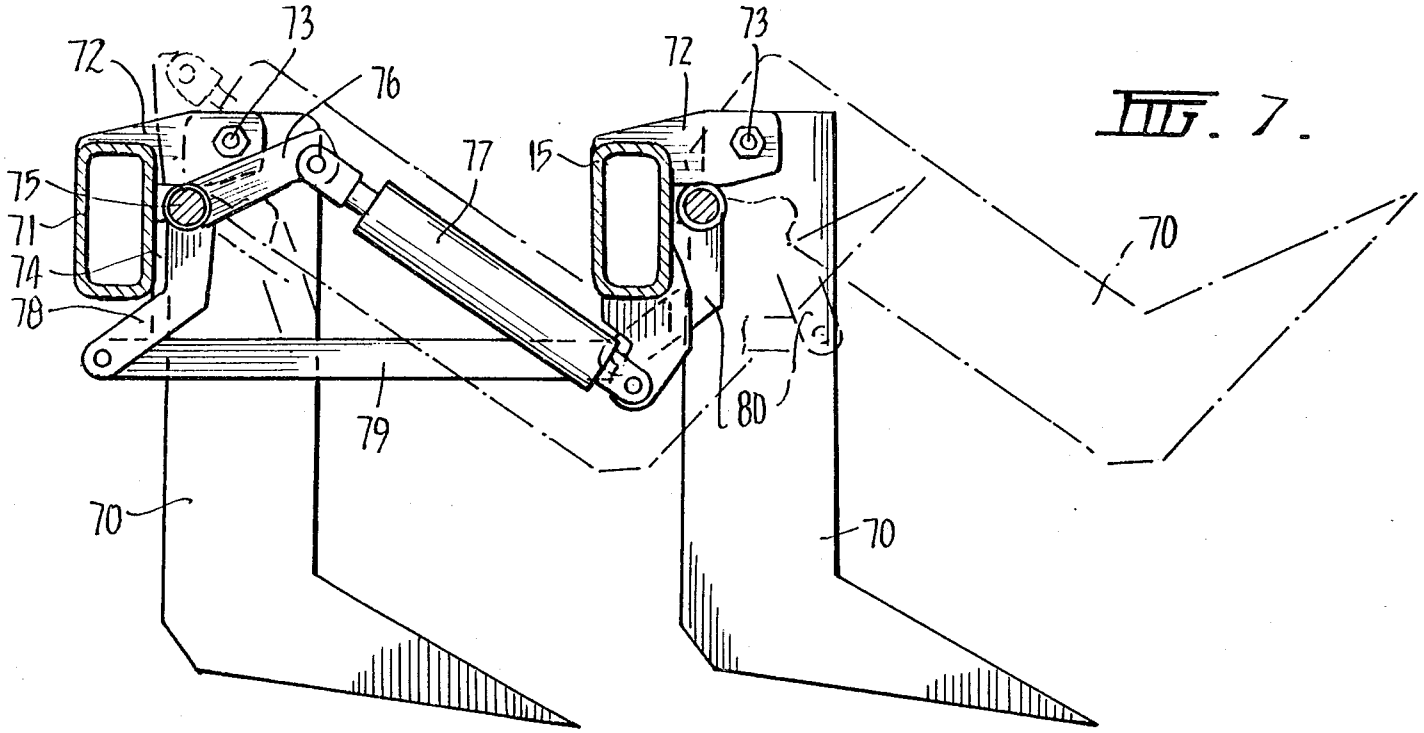
FIG. 7 is a partial enlarged section along line 7—7 of FIG. 6 and showing the tynes, in full line, in their operative condition and, in chain dash, in their inoperative condition.
Figure 8:
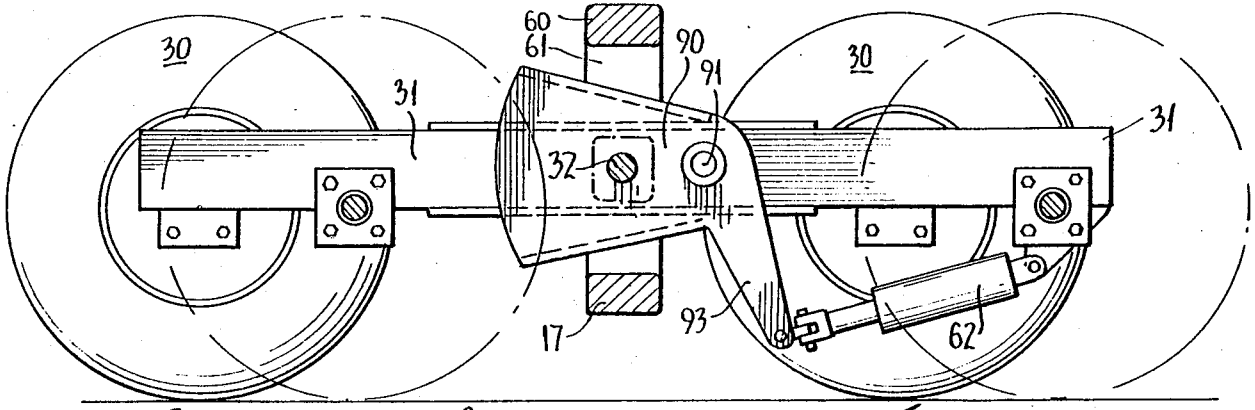
FIG. 8 is a section along line 8—8 of FIG. 1 showing the arrangement of the transverse adjusting mechanism for the frame of the equipment, with the frame being parallel across the width of the equipment.
Figure 9:
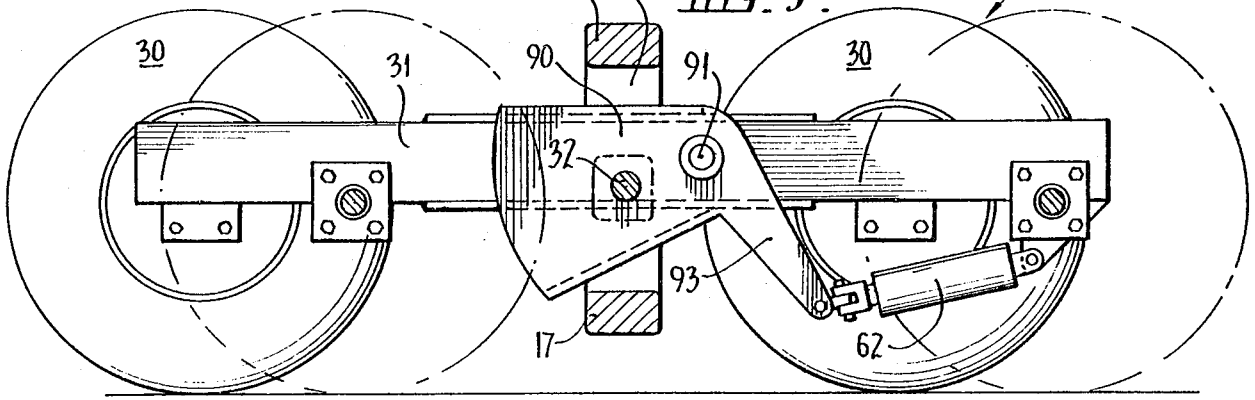
FIG. 9 is a view similar to that of FIG. 8 showing the side of the frame in its lowered condition.
Figure 10:
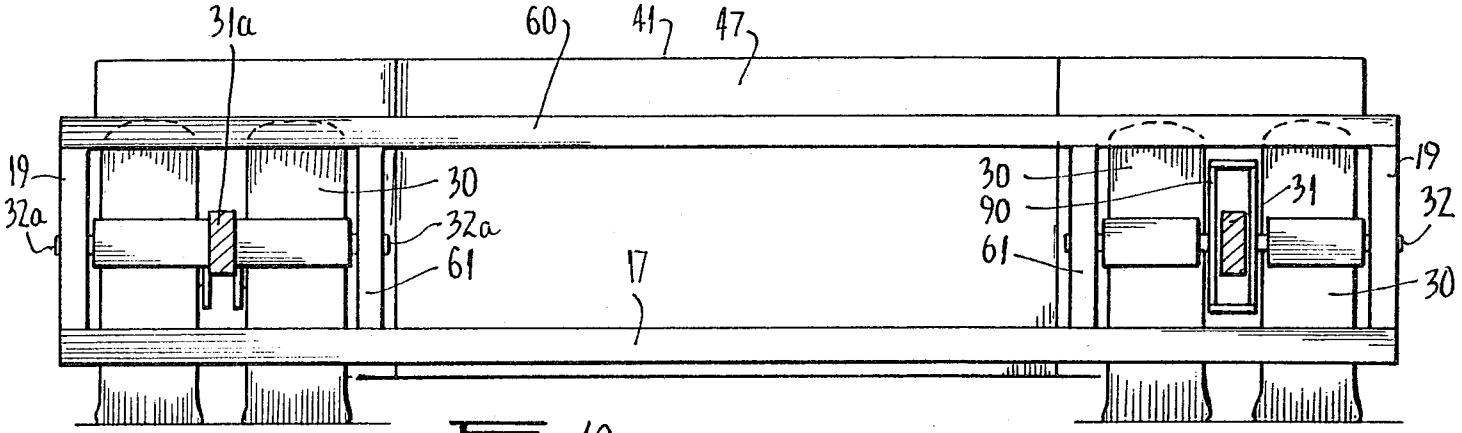
FIG. 10 is a view along line 10—10 of FIG. 1 with the frame in the condition illustrated in FIG. 8.
Figure 11:
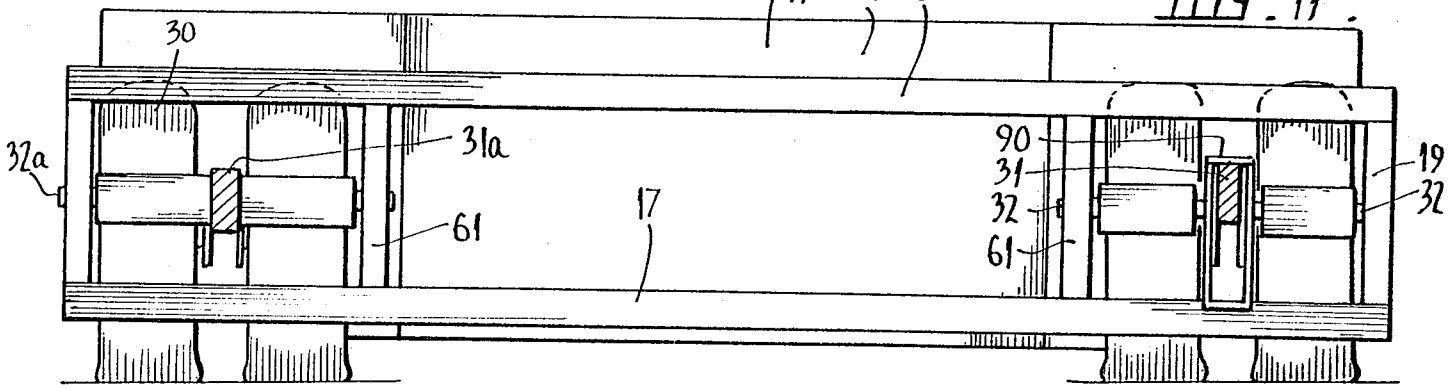
FIG. 11 is a view similar to FIG. 10 but showing the frame in the position illustrated in FIG. 9.

However, if the bars 75 are rotated the plates 74 cause the tynes to be rotated upwardly to assume the condition shown in chain dash in FIG. 7.

This rotation is achieved by providing a crank 76 on the rearward bar 75 which crank is in pivotal connection with the ram 77 which connects to the front transverse member 15.

A second crank 78 is also attached to the rearward bar 75 and this has a forwardly directed link 79 in pivotal connection with a crank 80 on the forward bar 75.

The orientation of the two cranks 78 and 80 are such that the two bars 75 are in the same relative angular position at all times.

As illustrated there are three bars 75, two being on the forward transverse member 15, one on each side of the hitch member 20.

As mentioned earlier herein, it is desirable to be able to alter the transverse configuration of the frame so as to have a variable depth of cut of the scraper blade 40 across the width of the equipment.

I do this by providing means whereby the height of the rearward section 12 of the frame relative to one of the pivotally mounted arms 31 on which the pairs of road wheels are mounted can be varied.

To achieve this I provide a bell-crank 90 which is pivotally connected to the arm 31 by pivot 91. One arm of the bell-crank is also pivotally connected by pivot 32 to the frame.

The other arm 93 of the bell crank is connected to an hydraulic ram 62 which, in turn, is connected to the arm 31. As the arm is extended so the arm 93 of the bell-crank moves towards the rear of the frame 10 and the frame is lifted relative to the arm 31 and, as the arm is kept at a constant distance from the ground, as it is supported by the road wheels 30, so the side of the frame rises.

When, on the other hand, the length of the ram 62 is reduced, so the frame is lowered relative to the arm 31 and, in this way, the side falls.

The equipment is provided with a mast 100 on which is mounted a laser light 101 and it is possible to automatically control the operation of the equipment by the rise and fall of the light.

In the foregoing I have discussed the operation of various components of the equipment of the invention individually but, for clarity, I shall now describe the various steps in the use of the equipment in the field.

Initially the forward end 22 of the hitch member 20 is connected to the tractor draw bar 23. Assuming that the device is to be used as a scraper, the hydraulic ram 77 is moved to its retracted condition, as shown in solid lines in FIG. 7, to enable the tynes 70 to rotate about their pivots 73 towards their working condition. The hydraulic rams 58 are retracted so that the rollers 56 move forwardly along the slots 57 and, at the same time the cranks 54 rotate about the pivot 55 and the apron 50 assumes the condition shown in full line in FIG. 5. The rams 44 are moved to their retracted position so that the container 41 adopts the position shown in FIG. 4.

The rams 25 are adjusted until the scraper blade 40 adopts a position relative to the ground similar to that illustrated in FIG. 2. If necessary, the ram 62 is adjusted until the transverse location of the rear of the frame 10 is as required.

If then, the equipment is drawn forward, the tynes 70 enter and break the ground and the blade 40 enters the broken ground to the required depth and the soil, guided by the wings 24, is moved rearwardly into the container 41. This operation continues until the container 41 is full, at which time the rams 58 are extended and this causes the apron 50 to rotate downwardly in an arcuate manner so that it cuts through soil piled in front of the blade 40 until it reaches the position shown in full line in FIG. 4, at which it closes the front of the container 41.

At this time the rams 25 are extended and this causes the two parts of the frame to rotate about the pivots 13, **13*a* and to adopt a position substantially as illustrated in FIG. 3. At that time, the ram 77 is extended causing the plates 74 to rotate with the bar 75 and the rotation of these plates causes rotation of the tynes so that they adopt a position shown in broken line in FIG. 7**. The equipment can then readily be towed without causing any disturbance of the surface over which it passes.

When it is required to empty the container 41, the rams 58 are again retracted and the rams 44 are extended, which extension causes rotation of the container 41 to permit delivery of the load from the container.

When the equipment is to be used as a grader, the apron 50 and the container 41 are left in the position illustrated in FIG. 5 and, by adjustment of the rams 25, so the height of the scraper blade 40 relative to the surface is adjusted and, if necessary, by adjustment of the position of the ram 62, so the transverse angle of the scraper blade is adjusted.

When working as a grader, excess soil can pass over the blade 40 and bank up against the inclined floor 46 of the container and can be delivered therefrom where there are depressions in the front of the blade.

I have not, in this specification, fully described the hydraulics necessary to enable variation of the various components and these can, if required, be interlocked and can automatically be controlled depending on variations of level of laser light, Also, in the illustrated embodiment I have shown the container 41 as being able to be rotated about the pivot 42 to enable delivery of soil therefrom. It is conventional in heavy scrapers to provide alternative ways of delivering soil from containers. In one of these the rear wall is formed to be able to be moved forwardly, thus causing soil to be passed from the front of the container and, in another, the floor of the container can be formed as a continuous conveyor whereby soil can be moved forwardly for delivery and, in fact, can also be moved rearwardly when it is entering into the container.

It will be appreciated that the various features of the present invention can readily be applied to equipment having such varied forms of container.

I claim:

1. Earth moving and land forming equipment including an open frame formed as a forward section and a rearward section pivoted together on a transverse axis, the forward section adapted to be connected at its forward end to a tractor draw bar and the rear of the rearward section being supported at each side by land wheels, the wheels on each side being carried on an arm pivotally mounted on said rearward section, a fixed scraper blade at the pivoted end of the said rearward section, a load carrying container behind the scraper blade, an apron pivotally mounted above and forwardly of the load carrying container the forward section having substantially vertical wings on either side thereof to guide soil to the load carrying container, the apron having a substantially downwardly directed edge, when it is in a, first, raised position in which it is located substantially above the scraper blade so as to leave the mouth of the load carrying container unimpeded, and means to cause the apron to rotate generally arcuately downwardly to a, second, lowered position in which the edge substantially abuts the scraper blade, the apron effectively closing the forward end of the load carrying container, the rotation being effected by hydraulic rams connected between the apron and formed slots in the wings, the slots constraining the ends of the rams to move in a fixed path to control the movement of the edge of the apron, means connected between the said forward and rearward sections, on each side of the frame pivot to effect raising and lowering movements of the said pivot and thus to the scraper blade.

2. Equipment as claimed in claim 1 wherein the required movement of the apron is obtained from cranks pivotally connected both to the apron and the forward section of the frame.

3. Earth moving and land forming equipment including an open frame formed as a forward section and a rearward section pivoted together on a transverse axis, the forward section adapted to be connected at its forward end to a tractor draw bar and the rear of the rearward section being supported at each side by land wheels, the wheels on each side being carried on an arm pivotally mounted on the said rearward section, the land wheels being in pairs, one wheel of each pair being on each side of the arm, the wheels of each pair being offset, one relative to the other, a fixed scraper blade at the pivoted end of the said rearward section, a load carrying container behind the scraper blade, hydraulic rams connected between the said forward and rearward sections, on each side of the frame pivot to effect raising and lowering movements to the said pivot and thus to the scraper blade.

4. Equipment as claimed in claim 3 wherein there are two pairs of land wheels attached to each arm, one pair of wheels being attached forward of the pivot, the other rearward of the pivot.

5. Equipment as claimed in claim 3 wherein the pivot of at least one of the arms to which the land wheels are connected is moveable vertically with respect to the frame so that the transverse angle of the frame can be varied.

6. Equipment as claimed in claim 5 wherein a bell-crank is connected to one of the arms to which the land wheels are connected, the pivot for the arm being connected to one of the arms of the bell-crank, a hydraulic ram being connected between the other arm of the bell-crank and the arm to which the land wheel is connected, the arrangement being such that on rotation of the bell-crank by the hydraulic ram so that frame member is moved vertically relative to the arm.

7. Equipment as claimed in claim 3, wherein the apron is pivotally mounted above and forwardly of the load carrying container and has a substantially downwardly directed edge, when it is in a first, raised, position in which it is located substantially above the scraper blade so as to leave the mouth of the load carrying container umimpeded and means to cause the apron to rotate generally arcuately downwardly to a second, lowered, position in which the edge substantially abuts the forward edge of the load carrying container, the apron effectively closing the forward end of the load carrying container.

8. Equipment as claimed in claim 7 wherein the pivotal movement of the apron is by means of cranks pivotally connected both to the apron and the forward section of the frame of the equipment.

9. Equipment as claimed in claim 8 wherein the rotation of the apron is effected by hydraulic rams connected between the forward section of the frame of the equipment and the apron, the rams being constrained to move in a fixed path to control the movement of the edge of the apron.

10. Earth moving and land forming equipment including an open frame formed as a forward section and a rearward section pivoted together on a transverse axis, the forward section adapted to be connected at its foward end to a tractor draw bar and the rear of the rearward section being supported at each side by land wheels, the wheels on each side being carried on an arm pivotally mounted on the said rearward section, a fixed scraper blade at the pivoted end of the said rearward section, a load carrying container behind the scraper blade, hydraulic rams connected between the forward and rearward sections, on each side of the frame pivot to effect raising and lowering movements to the said pivot and thus to the scraper blade, ripper tynes ahead of the fixed scraper blade, the tynes being moveable from a first working position at which they are in contact with the ground to a second transport position where there is no contact, each tyne being pivotally connected to a member the tyne, in its working condition abutting the member thereby being restricted against rotation, a rotatable bar extending along the member, a plate associated with each tyne and connected to the rotatable bar, rotation of the bar causing the plates to effect rotation of each tyne about its pivot to the transport position.

11. Equipment as claimed in claim 10 wherein there are a plurality of tynes each individually pivotally connected to a member which lies transverse of the equipment, a bar connected to the member for axial rotation relative thereto, a plate associated with each tyne, each plate being connected to the rotatable bar so that on rotation of the bar all tynes are moved away from, or permitted to move towards their working positions.

12. Equipment as claimed in claim 11 wherein tynes are located on two spaced members, a bar rotatably connected to each member and to which plates are connected and a mechanical linkage between the two bars so that rotation of one bar causes an equivalent rotation of the other bar.

13. In earth moving equipment having a frame, land wheels mounted on at least one arm adjacent either rear of the frame and each side of the equipment, the arms being pivotally attached to the frame, the pivot of at least one of the arms to which the land wheels are connected being moveable vertically with respect to the frame so that the transverse angle of the frame can be varied.

14. Equipment as claimed in claim 11 having a bell-crank or the like connected to one of the arms to which the land wheels are connected, the pivot for the arm being connected to one of the arms of the bell-crank, a hydraulic ram being connected between the other arm of the bell-crank and the arm to which the land wheel is connected, the arrangement being such that on rotation of the bell-crank by the hydraulic ram so the frame member is moved vertically relative to the arm.

15. In earth moving equipment having ripper tynes, the tynes being moveable from a first, working, position in which they are in contact with the ground to a second, transport, position where there is no contact, each tyne being pivotally connected to a member, a rotatable bar extending along the member, a plate pivotally connected to the member, each tyne, in its working condition abutting the member, rotation of the bar causing the plate to effect rotation of tyne about its pivot to the transport position.

16. Equipment as claimed in 14 having a plurality of tynes each individually pivotally connected to a member which lies transverse of the equipment, a bar connected to the member for axial rotation relative thereto, a plate associated with each tyne, each plate being connected to the rotatable bar so that on rotation of the bar all tynes are moved away from, or permitted to move towards their working positions.

17. Equipment as claimed in claim 16 wherein tynes are located on two spaced members, a bar rotatably connected to each member and to which plates are connected and a mechanical linkage between the two bars so that rotation of one bar causes an equivalent rotation of the other bar.

* * * * *